United States Patent [19]

Dragone

[11] 4,250,508

[45] Feb. 10, 1981

[54] SCANNING BEAM ANTENNA ARRANGEMENT

[75] Inventor: Corrado Dragone, Little Silver, N.J.

[73] Assignee: Bell Telephone Laboratories, Incorporated, Murray Hill, N.J.

[21] Appl. No.: 33,734

[22] Filed: Apr. 26, 1979

[51] Int. Cl.[2] ..... H01Q 19/12

[52] U.S. Cl. ..... 343/779; 343/781 CA; 343/837; 343/DIG. 2

[58] Field of Search ..... 343/779, 781 R, 781 P, 343/781 CA, 837, DIG. 2, 854

[56] References Cited

U.S. PATENT DOCUMENTS

| | | | |
|---|---|---|---|
| 2,436,408 | 2/1948 | Tawney | 343/779 |
| 2,656,464 | 10/1953 | Robinson | 343/780 |
| 2,870,441 | 1/1959 | Hines | 343/781 |
| 3,067,421 | 12/1962 | O'Nians et al. | 343/779 |
| 3,267,472 | 8/1966 | Fink | 343/100 |
| 3,500,411 | 3/1970 | Kiesling | 343/100 |
| 3,500,427 | 3/1970 | Landesman et al. | 343/836 |
| 3,518,689 | 6/1970 | Algfo et al. | 343/778 |
| 3,680,140 | 6/1972 | Chalfin et al. | 343/754 |
| 3,766,558 | 9/1973 | Kuechken | 343/100 |
| 3,864,689 | 2/1975 | Young | 343/854 |

OTHER PUBLICATIONS

Dragone; Imaging Reflector Arrangements to Form a Scanning Beam Using a Small Array; B.S.T.J. Vol. 58, No. 2, Feb. 1979, pp. 501–515.

*Primary Examiner*—Eli Lieberman

*Attorney, Agent, or Firm*—Erwin W. Pfeifle

[57] ABSTRACT

The present invention relates to an antenna arrangement capable of generating one or more linearly scanning spot beams which are scanned over separate strip portions of the entire field of view of the antenna. The antenna arrangement comprises an optical system comprising an aperture and a focal plane, and a novel feed arrangement. The feed arrangement comprises a separate linear phased array disposed within a separate rectangular waveguide section for each linear scanning beam desired. An offset curved reflector, disposed in each waveguide section, converts a linearly scanning planar wavefront generated by an array into a converging beam forming a linearly moving point source on the antenna's focal plane with the principle ray of each instantaneous wavefront being directed at the center of an image of the aperture of the optical system as seen by the feed arrangement.

8 Claims, 4 Drawing Figures

SCANNING BEAM ANTENNA ARRANGEMENT

BACKGROUND OF THE INVENTION

1. Field of the Invention

The present invention relates to a scanning beam antenna arrangement and, more particularly, to a scanning beam antenna arrangement capable of providing one or more spot beams which scan separate linear strips of the entire field of view of the antenna system, the arrangement comprising an optical system and a separate feed arrangement for each beam. Each feed arrangement comprises a linear phased array disposed within a parallel waveguide section with each section comprising an offset curved reflecting surface for bidirectionally reflecting a planar wavefront, at the array side thereof and scannable along one angular coordinate, into a converging wavefront at the other side thereof which is focused on the focal plane of the optical system and the principle ray thereof moves along a line at the aperture of the waveguide section and is always focused to a particular point on the image of the aperture of the optical system as seen by the feed arrangement.

2. Description of the Prior Art

Recently suggested designs for future generation satellite communication systems have proposed the use of one or more scanning spot beams at a satellite switching repeater for separately receiving and transmitting signals associated with a plurality of remote, spaced-apart, ground stations. One of the most recent designs, also forming the subject matter of a copending patent application Ser. No. 33,735, filed for A. Acampora et al on the same day as the present application and assigned to the same assignee, incorporates a satellite switching repeater which uses a plurality of linear scanning spot beams to concurrently scan along separate parallel strips of the overall ground service region of the satellite communication system in accordance with a predetermined communication sequence. Such system, however, would require a scanning beam antenna arrangement which can provide one or more linear scanning beams which are efficiently directed over separate strip regions of the overall service region.

Known scanning antennas have taken many forms. One such antenna is disclosed in U.S. Pat. No. 2,656,464 issued to C. V. Robinson on Oct. 20, 1953 which relates to a microwave scanning antenna of the "pill box" type arrangement. More particularly, the scanning antenna comprises a semi-parabolic reflector surface positioned at one end of a parallel-plate waveguide member; a movable waveguide feedhorn for illuminating the semi-parabolic reflector surface in the waveguide member; and means for mounting and pointing the feedhorn from the focus toward a point in the mid-region of the reflector and for moving the feedhorn along a portion of an arc of the circle which is tangent to the reflector at the point and passes through the focus, whereby a scanning output radiation beam is produced at the aperture of the waveguide member.

Another antenna arrangement is disclosed in U.S. Pat. No. 3,500,427 issued to S. Landesman et al on Mar. 10, 1970 which relates to a steerable antenna system for sweeping a given area of space with a first radiation lobe having high gain. The antenna system comprises a small panel of radiating elements associated with an optical system which may comprise two reflectors using either parts of cylindrical surfaces when scanning in only one angular coordinate is desired or parts of a quadric surface when scanning in both elevation and azimuth are desired.

Still another antenna arrangement is disclosed in U.S. Pat. No. 3,500,411 issued to J. D. Kiesling on Mar. 10, 1970 which relates to a retrodirective phased array antenna usable in a communication satellite and capable of providing several beams each of which may be electronically steered by an external beacon or ground station to provide scanning capabilities. The antenna comprises a reflecting surface and a plurality of antenna elements positioned near the focal plane of the reflecting surface. In operation, a beam from a ground station is reflected by the reflecting surface onto a portion of the antenna elements. Other antenna elements not illuminated by the beam are operated to emit a beam towards the same or other ground stations dependent on the properties of the received signal, e.g., the amplitude and phase.

Yet another antenna arrangement is disclosed in U.S. Pat. No. 3,766,558 issued to J. A. Kuechken on Oct. 16, 1973 which relates to a raster scan antenna capable of scanning in one or two planes. The antenna comprises a plurality of feed elements in a phased array where beam steering is effected by progressive phase shifts introduced to the various array elements. To effect the raster scan capability, a prime oscillator frequency $f_o$ is mixed with a variable steering oscillator frequency $f_s$ to produce sum and difference frequencies $f_o+f_s$ and $f_o-f_s$. The latter is fed to a delay line having a plurality of taps spaced apart in accordance with the particular arrangement of array elements, the delay line providing in the frequency signal $f_o-f_s$ progressive phase shifts from tap to tap. The individual tap outputs are separately mixed with the sum frequency signal $f_o+f_s$, wherein N separate outputs are simultaneously derived having the same frequency of $2f_o$ but varying from one another progressively in phase. Variation of $f_s$, which causes the phase relationship between the N outputs to change as they are fed to the radiators in one-to-one correspondence, thus provides a sweep of the beam in one plane. Raster type scanning is provided by introducing a multi-tapped secondary delay line at each tap of the primary delay line and mixing instead the tap outputs of each secondary delay line individually with $f_o+f_s$ and applying the resultant $2f_o$ outputs to individual ones of a corresponding element row of a two-dimensional array. The tapped spaacings on each of the secondary delay lines relative to the tapped spacings of the primary delay line is such as to provide scanning of an order of magnitude more sensitive in one plane.

In the article "Imaging Reflector Arrangements to Form a Scanning Beam using a Small Array" by C. Dragone et al in *The Bell System Technical Journal,* Vol. 58, No. 2, February 1979 at pp. 501–515, a small phased array is combined with a large main reflector and an imaging arrangement of smaller reflectors to form a large image of a small array over the main reflector. An electronically scannable antenna with a large aperture is thus obtained, using a small array disposed on a plane which is the conjugate plane of the main reflector plane. With such an arrangement, small imperfections in the reflecting surface of the main reflector can be corrected efficiently at the array.

The prior art scanning beam antenna systems, however, provide a scanning spot beam with either a two dimensional phased array or a linear phased array which radiates electromagnetic energy that is reflected from the entire reflecting surface of a main reflector. Where a linear phased array is caused to transmit a beam of electromagnetic energy which only reflects from a strip portion of the main reflector, only a fan beam is obtained which illuminates all of a strip portion of the entire field of view of the antenna system which fan beam can then be scanned across the entire field of view. The problem remaining in the prior art is to provide a feed system which produces a linearly moving spot beam along a strip portion of the entire field of view of the antenna system that is capable of being combined with other similar feed systems to use the same optical reflectors and provide a plurality of linear scanning spot beams which are scannable parallel to each other along different strip portions which strip portions cover the entire field of view of the antenna system.

SUMMARY OF THE INVENTION

The foregoing problem has been resolved in accordance with the present invention which relates to a feed arrangement comprising a linear array of feed elements disposed within a rectangular waveguide section including an offset curved focusing reflecting surface which bidirectionally converts an essentially planar wavefront from the array into a converging wavefront that is focused to a focal point on the focal plane of the feed arrangement. When the array is scanned in one angular coordinate the resulting point sources at the focal plane move along a straight line and are always directed at a predetermined remote point beyond the focal plane regardless of the direction of scan along the one angular coordinate.

It is also an aspect of the present invention to provide a scanning beam antenna arrangement capable of providing one or more spot beams which scan separate linear strips of the entire field of view of the antenna system, the arrangement comprising an optical system and a separate feed arrangement for each beam. Each feed arrangement comprises a linear phased array disposed within a parallel waveguide section with each section comprising an offset curved reflecting surface for bidirectionally reflecting a planar wavefront, at the array side thereof and scannable along one angular coordinate, into a converging wavefront at the other side thereof which is focused on the focal plane of the optical system and the principle ray thereof moves along a line at the aperture of the waveguide section and is always focused to a particular point on the image of the aperture of the optical system as seen by the feed arrangement.

Other and further aspects of the present invention will become apparent during the course of the following description and by reference to the accompanying drawings.

BRIEF DESCRIPTION OF THE DRAWING

Referring now to the drawings, in which like numerals represent like parts in the several views.

DETAILED DESCRIPTION

The present invention is being described hereinafter primarily in association with an offset two-reflector Cassagrain antenna arrangement. However, it is to be understood that such description is exemplary only and not for purposes of limitation. It will be readily appreciated that the inventive concept described is equally applicable to any optical system or arrangement of one or more reflectors which focuses a planar wavefront received at the aperture of the antenna arrangement.

Figure 1:
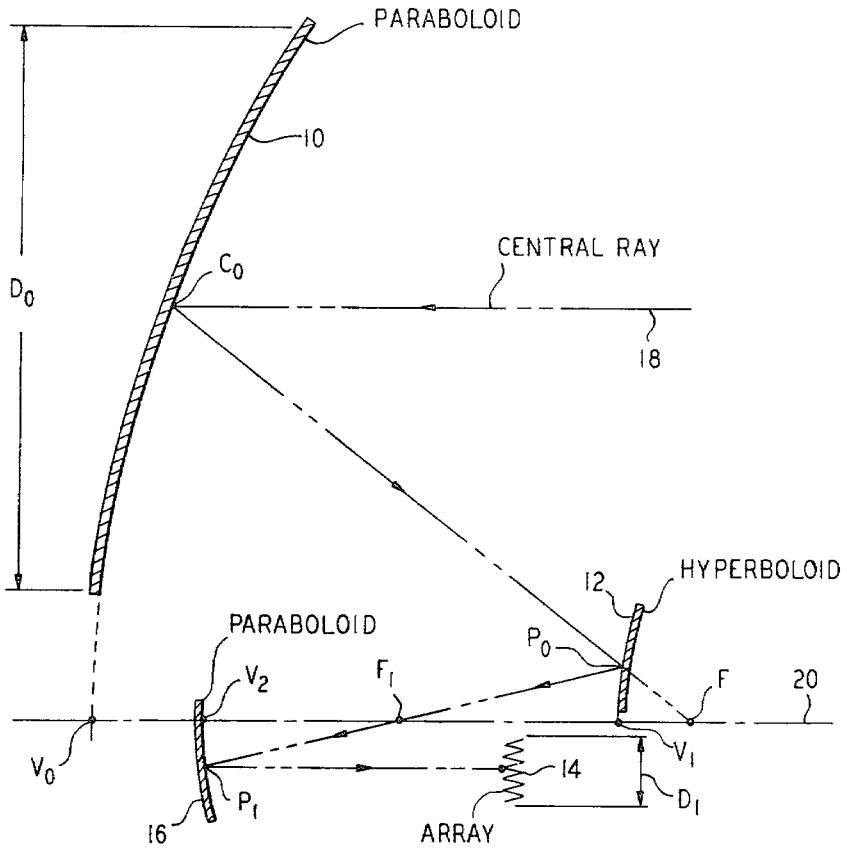
FIG. 1 (PRIOR ART)
FIG. 1 is a partial side cross-sectional view of a typical prior art offset three-reflector Cassagrainian antenna arrangement.

FIG. 1 illustrates a prior art antenna arrangement comprising a Cassagrain portion including a main paraboloid reflector 10 and a hyperboloid subreflector 12 arranged confocally and coaxially in an offset arrangement and an array 14 with a paraboloid imaging reflector 16. This arrangement provides a magnified image of a small feed array 14, having a diameter $D_1$, which is formed over the aperture, having a diameter $D_0$, of the main reflector 10. In FIG. 1, $C_0$, $P_0$ and $P_1$ represent the central points of reflectors 10, 12 and 16, respectively; F represents the focal point of main reflectors 10 and one of the two focal points of hyperboloid subreflector 12; and $F_1$ represents the other focal point of hyperboloid subreflector 12 and the focal point of paraboloid imaging reflector 16. As shown in FIG. 1, and described in the hereinbefore mentioned *BSTJ* article by C. Dragone et al, the above-described reflectors are arranged in a manner so that a central ray 18 of a planar wavefront approaching main reflector 10 parallel to the common reflector axis 20 of reflectors 10, 12 and 16 is reflected by main reflector 10 at point $C_0$ towards focal point F. The central ray 18 is next reflected by hyperboloid subreflector 12 at point $P_0$ toward focal point $E_1$ and point $P_1$ on imaging reflector 16 to be reflected thereat to the central point on array 14. Points $V_0$, $V_1$ and $V_2$ merely represent the vertexes of reflectors 10, 12 and 16, respectively, on common axis 20 connecting focal points F and $F_1$.

In accordance with the prior art arrangement of FIG. 1, because of imaging by the reflectors, the field distribution over the two dimensional array aperture, $D_1$, is reproduced faithfully over the much larger aperture $D_0$ of the main reflector 10. Thus, a narrow spot beam, which may be directed efficiently towards any ground area portion of the total field of view in, for example, the U.S.A. can be obtained with such antenna arrangement. However, where many such beams are desired to be produced from separate arrays using the same optical system of reflectors 10 and 12, many problems are encountered. For one, multiple two-dimensional phased arrays cannot occupy the same position on the focal plane of the antenna system. In the prior art arrangements, spot beams have been obtained using either a single feed element or a cluster of feed elements appropriately positioned on the focal plane, a linear array or a two dimensional array. All such feeds must radiate electromagnetic energy which covers all of the reflecting surface of a main reflector 10 to obtain a spot beam. Where a linear phased array, for example, radiates a beam of electromagnetic energy which only covers a strip portion of the main reflector 10, then only a fan beam, and not a spot beam, is obtained which can be scanned back and forth across the field of view of the antenna system.

Figure 2:
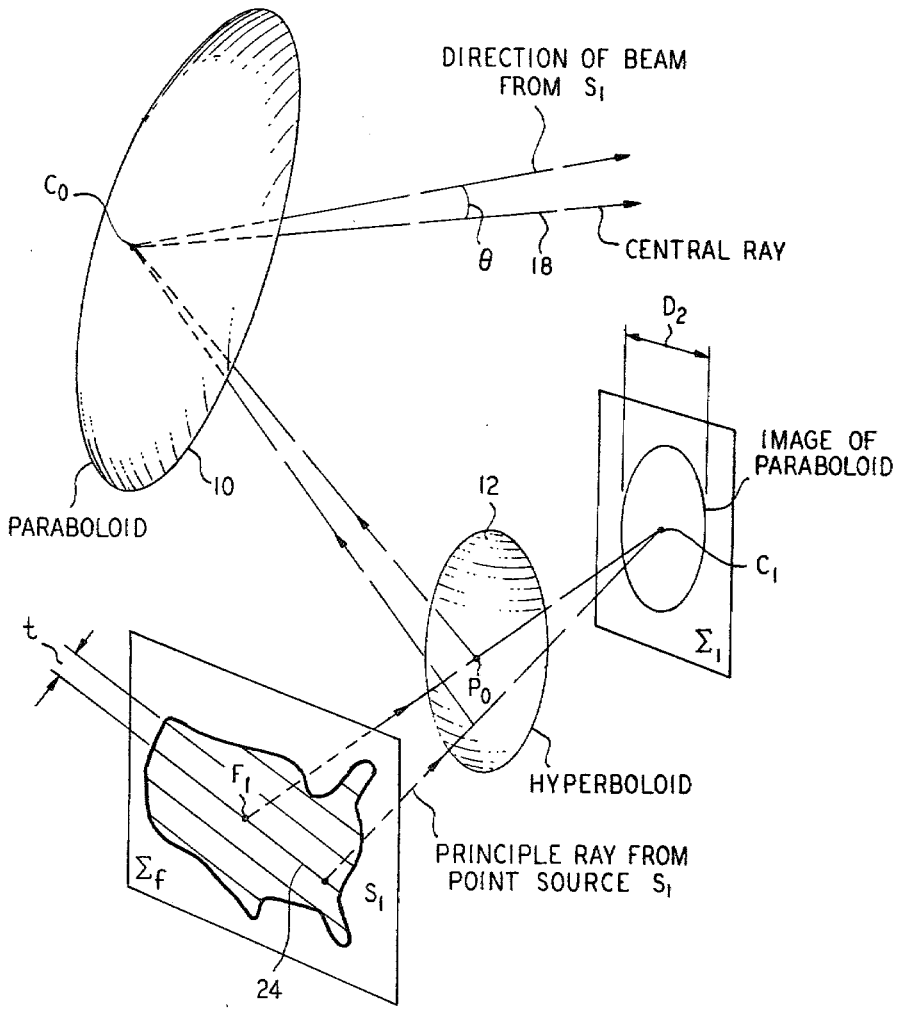
FIG. 2 is a view in perspective of the two-reflector Cassagrainian portion of the arrangement of FIG. 1.

In accordance with the present invention, a limited scanning spot beam is obtained using a linear phased array feed arrangement which covers only a portion of the entire field of view of an optical system which can be combined with other such feed arrangements to produce many such limited scanning spot beams. To this purpose, FIG. 2 illustrates an offset Cassegrain antenna arrangement, as shown in part in FIG. 1, for use at a satellite comprising a main paraboloid reflector 10 and a hyperboloid subreflector 12 so as to form on the focal plane $\Sigma_f$ thereof, a small image of the U.S.A. Then, for each remote ground station $S_x$ in the United States, there will be a corresponding image on focal plane $\Sigma_f$. For example, point $S_1$ corresponds to an image of a ground station located in the southeast section of the United States as, for example, in Atlanta, Ga. In order to form at the satellite a beam radiated in the direction of Atlanta, Ga., a feed acting as a point source $S_1$ must be placed on the focal plane $\Sigma_f$. It can be shown that the angle $\theta$ specifying the direction of the beam from point source $S_1$ in FIG. 2 is related to the displacement $l=|S_1F_1|$ through the relation $$\theta \approx l/F, \tag{1}$$

where f is the equivalent focal length of the Cassegrain arrangement.

As shown in FIG. 2, the hyperboloid subreflector 12 forms on plane $\Sigma_1$ at a distance $d=S_1C_1$ from $S_1$ a virtual image of the paraboloid reflector 10. This image is centered at $C_1$, and its diameter $D_2$ is related to the diameter $D_0$ of the paraboloid reflector 10 by the equation $$D_0 \approx D_1M_1, \text{where}\left(M_1 = \frac{|C_0P_0|}{|P_0C_1|}\right). \tag{2}$$

Thus, in order to maximize aperture efficiency, the spherical wave radiated from the point source $S_1$ must illuminate efficiently this image and, therefore, it must satisfy the requirements that (1) the illuminated area on $\Sigma_1$, must have diameter $D_2$, approximately, and (2) the spherical wave from point $S_1$ must be centered around the ray proceeding in FIG. 2 from point source $S_1$ towards point $C_1$.

The above ray proceeding from point source $S_1$ towards point $C_1$ will be called the principle ray and, $S_1$, the feed phase center. A straight line 24 is then drawn through $S_1$ and another point as, for example, focal point $E_1$ on the focal plane $\Sigma_f$ and in addition to the above two requirements, it will be also required that by varying the feed excitation the location of $S_1$ will be movable on this line 24.

Figure 3:
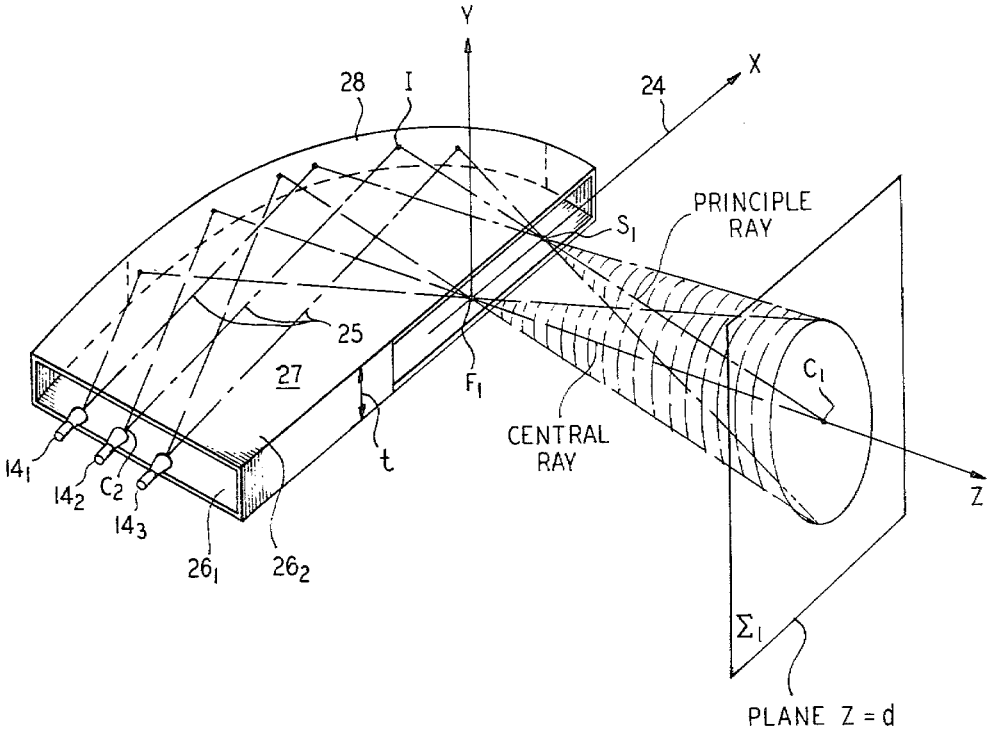
FIG. 3 is a view in perspective of the feed arrangement in accordance with the present invention capable of use with the antenna arrangements of FIGS. 1 or 2.

In accordance with the present invention, a feed arrangement which will satisfy the above-mentioned three requirements is shown in FIG. 3. A linear array 14, of which three feed elements $\mathbf{14}_1$, $\mathbf{14}_2$ and $\mathbf{14}_3$ are shown, with the array aperture centered at $C_2$ radiates a planar wavefront 25 which is guided between two parallel plates $\mathbf{26}_1$ and $\mathbf{26}_2$ of a rectangular waveguide section 27. The planar wavefront propagates in the direction of the principle ray which originates at point $C_2$ and is reflected by a reflector 28 at point I into a converging wavefront which is focused and passes through the phase center $S_1$ at the aperture of the waveguide section 27. In order to satisfy requirement (2) mentioned hereinabove, the curve of reflector 28, defined by the cylinder on the plane $y=0$, must be an ellipse and have the foci $C_1$ and $C_2$.

To determine the illumination of the reflected planar wavefront through point $S_1$ over the plane $\Sigma_1$ located at, for example, $z=d$, it will be assumed that plane $\Sigma_1$ is in the far-field of the feed. It has been assumed, so far, that the wave radiated by the feed arrangement is a spherical wave. In general, if this condition is not satisfied, the wavefronts illuminating the plane $z=d$ will have different curvatures in the two principle planes and, therefore, the phase centers in the two planes will be different. In FIG. 3, the phase center in the principle plane orthogonal to the plates $\mathbf{26}_1$ and $\mathbf{26}_2$ is located on the feed aperture and is given by the point $S_1$. The other phase center is a focal point determined on the principle ray by the wave reflected by the elliptical cylinder reflector 28. It can be concluded that, if the plane $z=d$ is to be illuminated by a spherical wave from point source $S_1$, the above-mentioned focal point must coincide with point $S_1$, and the array excitation must be chosen so as to satisfy this requirement. In the particular case where $$\frac{1}{|IS_1|} = \frac{1}{|C_2I|} + \frac{1}{|IC_1|}, \tag{3}$$

it can be shown that the required array excitation is a plane wave.

The next consideration is the amplitude distribution over the plane $z=d$ which can be shown to be the product of two functions, F(x) and G(y), related respectively to the Fourier transforms of the field distributions along the x- and y-axes on the feed aperture. Taking this into account, it is found that G(y) is independent of the feed excitation, and such function is determined only by the separation, t, of the plates $\mathbf{26}_1$ and $\mathbf{26}_2$, and by the polarization of the array 14. If one requires, at the edge of the paraboloid for $x=0$ and $y=D_1/2$, an illumination of $-10$ dB with respect to the center $x=y=0$, it is found that the separation, t, must be given by $$t_1 = 1.48\,\lambda\frac{f}{D_p}, \text{ or } t_2 = 2.12\,\lambda\frac{f}{D_p}, \tag{4}$$

depending on whether the electric field polarization inside the feed is orthogonal or parallel, respectively, to the plates.

The other distribution, F(x), on the other hand, is determined by the array excitation, and since $C_1$ and $C_2$ are conjugate points, it can be shown that F(x) is the image of the array distribution to be designated $A(\mu)$ and given by the equation $$|F(x)|^2 \approx \left|A\left(\frac{x}{M_2}\right)\right|^2 \frac{1}{M_2}, \tag{5}$$

$M_2$ being the magnification $$M_2 \approx \frac{|C_1I|}{|C_2I|}, \tag{6}$$

if both the array aperture and the plane $z=d$ are orthogonal to the principle ray.

From the hereinbefore discussion, it can be concluded that by properly choosing the array amplitude distribution and the separation, t, of the plates $26_1$ and $26_2$, efficient illumination of the paraboloid reflector 10 aperture $D_0$ will be obtained. By charging the array phase distribution, the phase center $S_1$ will move along a straight line 24 along the x axis, as indicated in FIG. 3. The corresponding beam direction along line 24 will describe, on the earth, a curve given by the projection of this line.

Figure 4:
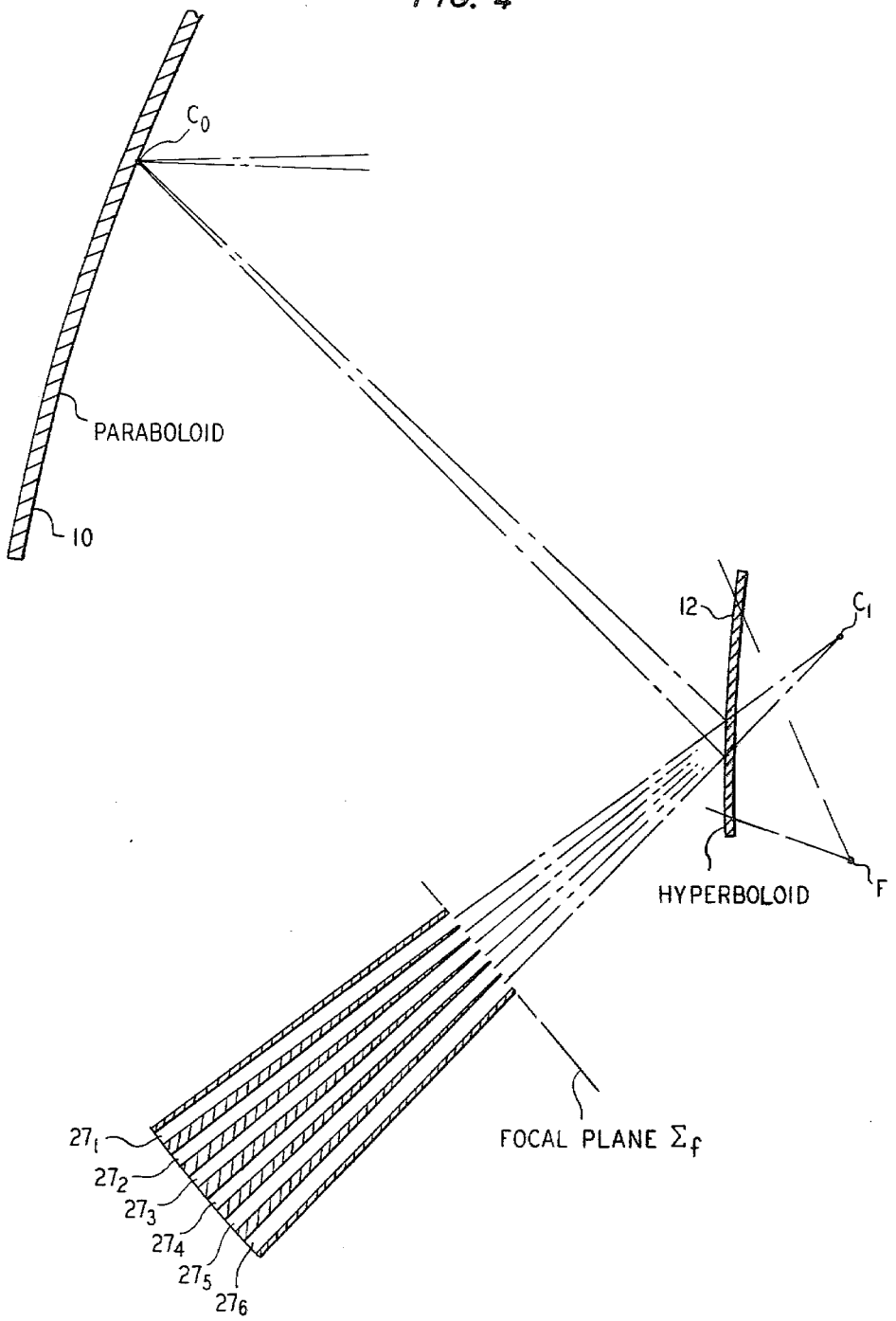
FIG. 4 illustrates an antenna system comprising a plurality of feed arrangements, as shown individually in FIG. 3, for providing coverage with their apertures of the entire field of view of the antenna system.

The above-described feed arrangement of FIG. 3 will effectively scan a strip portion of the United States when the principle ray is scanned along, for example, line 24 of FIG. 1 and covers a band with the width, t, on focal plane $\Sigma_f$ that can be correlated to a width on the earth. To cover the entire field of view of the antenna system, a set of identical feeds are placed in the focal plane $\Sigma_f$ with their phase centers $S_1$ movable along lines spaced a width, t, apart and parallel to each other so as to cover with their apertures the entire image of the United States. Such an arrangement is shown in FIG. 4. There, six feed arrangements $27_1$–$27_6$ identical to that shown in FIG. 3, are shown mounted adjacent to one another with the aperture of each feed arrangement disposed on the focal plane $\Sigma_f$ and disposed so that the plane of each feed arrangement passes through point $C_1$ on the image of the aperture of the antenna system. With such a feed arrangement, a set of parallel lines with spacing t will be obtained, and for each line there will be a movable phase center producing a beam.

It has been described hereinbefore that for efficient illumination of the paraboloid a different value of separation, t, between the plates $26_1$ and $26_2$ must be used depending on whether the feed polarization is parallel or orthogonal to the plates. It is thus convenient to use two separate feeds for the two polarizations. Then, as is well known in the art, for example, a grid of straight wires would then be required between the hyperboloid and the focus $F_1$. Signals with polarization orthogonal to the wires will pass through the wires, whereas total reflection will occur for the signals with a polarization parallel to the wires of the grid. Two separate focal planes are thus obtained for the two polarizations where the two separate feed arrangements of FIG. 3 or 4 are then placed. Assume, over one focal plane, the field is parallel to the plates, and it is orthogonal in the other case. If then separation, t, of plates $26_1$ and $26_2$ is chosen according to Eqs. (4), the same edge illumination will be obtained in the two cases.

It is to be understood that the above-described embodiments are simply illustrative of the principles of the invention. Various other modifications and changes may be made by those skilled in the art which will embody the principles of the invention and fall within the spirit and scope thereof.

I claim:

1. A feed arrangement for use with an antenna system characterized in that the feed arrangement comprises a linear phased array of feed elements (14) capable of effecting an essentially planar wavefront (25) which is scannable along one angular coordinate, the array being disposed within a rectangular waveguide section (27) with the wide sides ($26_1$, $26_2$) thereof oriented parallel to both the linear array and said one angular coordinate, the rectangular waveguide section comprising an offset curved focusing reflecting surface (28) disposed therein for bidirectionally converting an essentially planar wavefront propagating between the linear array and the reflecting surface into a converging wavefront which is focused to a point source at a focal plane ($\Sigma_f$) of the feed arrangement and when the array is scanned along said one angular coordinate the resulting point sources of a scanning wavefront move along a straight line of the focal plane, and the principle ray of each converging wavefront is always directed at a predetermined remote point beyond the focal plane regardless of the direction of scan along said one angular coordinate.

2. A feed arrangement according to claim 1 characterized in that the feed arrangement further comprises at least one additional linear phased array of feed element (14) capable of generating an essentially planar wavefront (25) which is scannable along one angular coordinate, each additional linear array being disposed within a separate rectangular waveguide section (27) with the wide sides ($26_1$, $26_2$) thereof oriented parallel to the associated linear array and said one angular coordinate, each rectangular waveguide section being (a) disposed alongside the other waveguide sections of the feed arrangement so that the linear arrays are parallel to each other and (b) comprising a separate offset curved focusing reflecting surface (28) disposed therein and capable of bidirectionally converting an essentially planar wavefront propagating between the associated linear array and said reflecting surface into a converging wavefront which is focused to a point source on said focal plane of the feed arrangement, and when each additional array is scanned along said one angular coordinate the resulting point sources of a scanning wavefront at the focal plane move along a straight line which is spaced apart and parallel to the straight lines of the other arrays, and the principle ray of each converging wavefront is always directed at said predetermined remote point beyond the focal plane regardless of the direction of scan along said one angular coordinate.

3. A feed arrangement according to claim 1 or 2 characterized in that the offset curved focusing reflector (28) in a rectangular waveguide section comprises a reflecting cylindrical surface which is elliptical in the plane of said linear array.

4. A scanning beam antenna arrangement comprising:

an optical system including an aperture ($D_0$) and a focal plane ($\Sigma_f$), the optical system being capable of bidirectionally converting an essentially planar wavefront at the aperture ($D_0$) into a converging wavefront which is focused at a focal plane ($\Sigma_f$) of the optical system; and a feed arrangement disposed on the focal plane of the optical system in a manner capable of intercepting the converging wavefront characterized in that the feed arrangement comprises a linear phased array of feed elements (14) capable of generating an essentially planar wavefront which is scannable along one angular coordinate, the array being disposed within a rectangular waveguide section (27) with the wide sides ($26_1$ and $26_2$) thereof oriented parallel to both the linear array and said one angular coordinate, the rectangular waveguide section comprising an offset curved focusing reflecting surface (28) disposed therein and capable of bidirectionally converting an essentially planar wavefront propagating between the linear array and the reflecting surface into a converging wavefront propagating between the reflecting surface and the optical system in a manner that each converging wavefront of the feed arrangement is focused at the focal plane ($\Sigma_f$) and is scanned linearly therealong, the principle ray in each converging wavefront being directed at essentially the central point of an image of the aperture ($D_0$) of the optical system as seen by the feed arrangement regardless of the direction of scan along said one angular coordinate, whereby a linear scanning spot beam is capable of being generated by the antenna arrangement which covers only a strip portion of an entire field of view of the antenna arrangement.

5. A scanning beam antenna arrangement according to claim 4 characterized in that the feed arrangement further comprises at least one additional linear phased array of feed elements capable of generating an essentially planar wavefront (25) which is scannable along one angular coordinate, each additional linear array being disposed within a separate rectangular waveguide section (27) with the wide sides ($26_1$, $26_2$) thereof oriented parallel to the associated linear array and said one angular coordinate, each rectangular waveguide section being (a) disposed alongside the other waveguide sections of the feed arrangement so that the linear arrays are parallel to each other and (b) comprising a separate offset curved focusing reflecting surface (28) disposed therein and capable of bidirectionally converting an essentially planar wavefront propagating between the associated linear array and said reflecting surface into a converging wavefront propagating between said associated reflecting surface and the optical system in a manner that each converging wavefront is focused at the focal plane of the antenna arrangement and is scanned linearly therealong parallel to the scanning wavefronts of the other linear arrays of the feed arrangement, and the principle ray of each of said converging wavefronts is directed at essentially the central point on said image of the main reflector regardless of the direction of scan along said one angular coordinate, whereby additional linear scanning spot beams are capable of being generated which cover separate parallel strip portions of said entire field of view of the antenna arrangement.

6. A scanning beam antenna arrangement according to claim 4 or 5 characterized in that the offset curved focusing reflector (28) in a rectangular waveguide section comprises a reflecting cylindrical surface which is elliptical in the plane of said associated linear array.

7. A scanning beam antenna arrangement according to claim 4 or 5 characterized in that the optical system comprises a focusing main reflector (10) comprising a reflecting surface capable of bidirectionally converting a planar wavefront at the aperture ($D_0$) of the antenna arrangement to an essentially spherical beam directed at a focal point (F) of the main reflector.

8. A scanning beam antenna arrangement according to claim 7 characterized in that the optical system further comprises a curved subreflector (12) disposed in the path to be taken by the essentially spherical beam from the main reflector, the subreflector being capable of bidirectionally reflecting the essentially spherical beam between the main reflector and a point on said focal plane and forming a virtual image of the aperture ($D_0$) and its central point.

* * * * *

UNITED STATES PATENT AND TRADEMARK OFFICE

CERTIFICATE OF CORRECTION

PATENT NO. : 4,250,508

DATED : February 10, 1981

INVENTOR(S) : Corrado Dragone

It is certified that error appears in the above—identified patent and that said Letters Patent is hereby corrected as shown below:

Column 2, line 4, "spaacings" should read -- spacings --. Column 4, line 30, "$E_1$" should read -- $F_1$ --. Column 5, line 24, "1" should read --ℓ --; line 25, "1" should read -- ℓ --; line 53 "$E_1$" should read -- $F_1$ --.

Signed and Sealed this

*Twenty-first* Day of *July 1981*

[SEAL]

*Attest:*

GERALD J. MOSSINGHOFF

*Attesting Officer*

*Commissioner of Patents and Trademarks*